United States Patent [19]

Yoshihara

[11] Patent Number: 4,498,611

[45] Date of Patent: Feb. 12, 1985

[54] DUAL DOOR TYPE ROTARY NOZZLE

[75] Inventor: Tetsuya Yoshihara, Yokohama, Japan

[73] Assignees: Nippon Kokan Kabushiki Kaisha, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 354,535

[22] Filed: Mar. 4, 1982

[51] Int. Cl.[3] ..... B22D 37/00

[52] U.S. Cl. ..... 222/599; 222/594; 222/534; 222/536

[58] Field of Search ..... 222/598, 601, 599, 597, 222/591, 526, 533, 537, 536, 594, 534; 164/337, 437; 251/367; 137/329.01, 329.02

[56] References Cited

U.S. PATENT DOCUMENTS 3,850,351 11/1974 Yoshihara ..... 222/598
3,856,189 12/1974 Meier ..... 222/537

FOREIGN PATENT DOCUMENTS 2555763 4/1976 Fed. Rep. of Germany ..... 167/337
22746 of 1914 United Kingdom ..... 222/591

*Primary Examiner*—Joseph J. Rolla
*Attorney, Agent, or Firm*—Fleit, Jacobson, Cohn & Price

[57] ABSTRACT

A sliding rotary nozzle assembly for pouring of molten steel has a bottom plate brick and a sliding plate brick, with these plate bricks being arranged as dual doors that may be opened and closed as desired relative to a base plate that includes a flow nozzle. Each of the brick plates is provided with plural nozzle openings and is carried for rotation with the bottom plate brick being positioned on top of the sliding plate brick when the doors are closed. In case of damage to nozzle opening of the rotary bottom plate brick, the dual doors are opened and the bottom plate brick is then rotated to bring the remaining nozzle opening to the use position to make best use of the bottom plate brick and prolong the service life of the nozzle assembly.

8 Claims, 7 Drawing Figures

DUAL DOOR TYPE ROTARY NOZZLE

BACKGROUND OF THE INVENTION

This invention relates to a slide rotary nozzle having a bottom plate brick and a sliding plate brick and mounted in a ladle for pouring of molten steel. More particularly, it relates to such slide rotary nozzle in which said brick plates are arranged as door plates.

In a slide rotary nozzle of the prior art, in which the bottom plate brick is fixed, the fixed plate brick has a single nozzle opening, while the sliding plate brick has two nozzle openings, and the sliding plate brick may be rotated for bringing one of its nozzle openings into register with the nozzle opening in the bottom plate brick for pouring of molten steel through the registered nozzle openings. The sliding plate brick is designed as a door and may be swung open for exposure of the sliding surfaces for visual inspection of the damaged state of the two plate brick surfaces and occasional exchange of the damaged plate bricks. The bottom and sliding plate bricks are exchanged as one set when one of the plate bricks has become worn through use.

In the conventional sliding rotary nozzle, the single nozzle in the bottom plate brick is used in conjunction with two nozzles in the sliding plate brick and thus the bottom plate brick may be worn out more promptly than the sliding plate brick. Hence, the sliding plate brick has to be exchanged with the worn out bottom plate brick while as yet the sliding plate brick is in usable state.

In addition, since the nozzle in the fixed plate brick is received in an upper nozzle socket in the conventional device, the bottom plate brick must be removed for exchange of the worn out upper nozzle, and the bottom plate brick thus removed must be discarded.

SUMMARY OF THE INVENTION

An object of the present invention is to provide a dual door type rotary nozzle which is free of the above defects of the prior art device and in which the bottom plate brick is designed as rotary plate brick which may be used more effectively for extending the service life of the nozzle and thereby extending the exchange time intervals of the bottom plate brick and the sliding plate brick.

Another object of the present invention is to provide a dual door type rotary nozzle wherein the upper nozzle may be exchanged while the bottom plate brick is mounted in position.

In the dual door type rotary nozzle of the present invention, the bottom and sliding plate bricks respectively have plural nozzle openings and are separately supported for rotation and in the form of a dual door with the bottom plate brick being disposed above the sliding plate brick.

According to the present invention, the bottom plate brick in the conventional device is replaced by a bottom plate brick having a plurality of, for example, two nozzle openings, so that, in case of injury to one nozzle opening, the remaining nozzle opening may come into use, thus enabling the bottom plate brick to be used more effectively for extending the service life of the nozzle.

Moreover, according to the present invention, not only the sliding plate brick but also the bottom plate brick may be swung open as door plates. The lower surface of the bottom plate brick is slidable relative to the sliding plate brick, while the upper surface of the bottom plate brick is fitted in the recess in the upper nozzle socket and would be unable to be rotated for exchange of the nozzle openings. However, due to the double door structure described in the foregoing, the upper nozzle and the bottom plate brick may be in contact with or swung away from each other. Thus the bottom plate brick may be rotated while it is separated from the upper nozzle for enabling smooth changeover from one to the other nozzle opening.

With the bottom plate brick arranged as door, it may be disengaged from the upper nozzle socket while it is swung open so that the upper nozzle may be exchanged without regard to the bottom plate brick thus eliminating the necessity to discard the usable bottom plate brick as in the conventional practice.

The above and other advantages of the present invention will be more fully understood by the following description which is made in conjunction with the accompanying drawings.

DESCRIPTION OF THE PREFERRED EMBODIMENT

Figure 1:
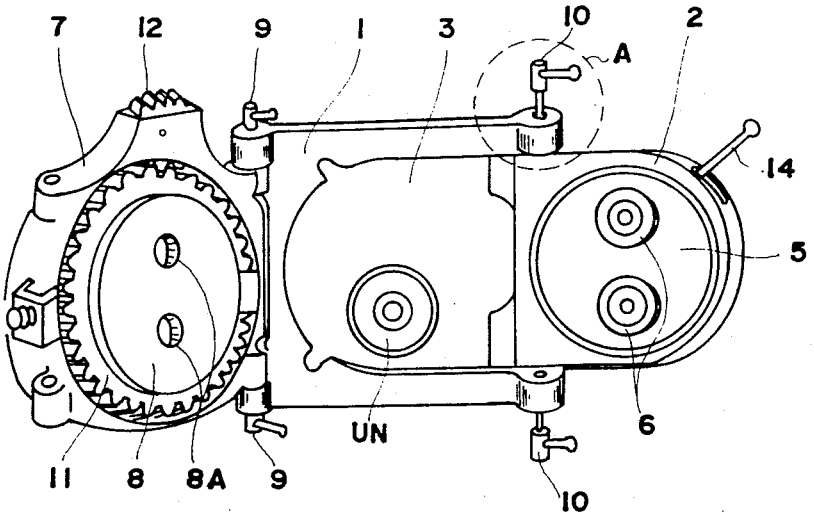
FIG. 1 is a perspective view, as seen from below, of the dual door type rotary nozzle of the present invention in the opened state.
Figure 2:
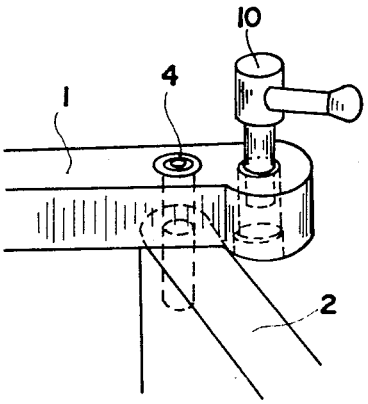
FIG. 2 is an enlarged partial view of a portion A in FIG. 1.

In FIG. 1, numeral 1 denotes a base plate having a central recess 3 in which a rotary plate brick receiver metal fixture 2 may have a snug fit when the metal fixture 2 is closed upon the base plate 1. The receiver metal fixture 2 is swingably carried by a shaft 4 to one side of the cassette metal fixture 1 as shown in detail in FIG. 2, and is snugly received in the recess 3 when swung to the closed position. In this position, a socket 6 of a bottom plate brick 5 secured to the metal fixture 2 coincides with a socket of an upper nozzle UN shown in FIG. 1. A slide plate receiver-rotor metal fixture 7 is used for housing a slide plate brick 8 and for rotating said brick 8. The metal fixture 7 is swingably carried to the other side of the cassette metal fixture 1 by a shaft 9 which is used simultaneously as rotational locking means. The metal fixture 7 is so designed and constructed that, when the fixture 7 is brought to a closed position in contact with the receiver metal fixture 2, a slide plate brick 8 secured to the metal fixture 7 is superimposed on the bottom plate brick 5 secured to the receiver metal fixture 2 and that, when the slide plate brick is slid in rotational movement, no interstices may be formed between the two plate brick surfaces.

In FIG. 1, a through-hole 8A is bored in the slide plate brick 8. A locking pin 9 is used for locking the receiver-rotor metal fixture to the base plate 1 against incidental opening when the receiver-rotor metal fixture has been closed. A rotor unit 11 is provided with gearing and used for halting or rotating said receiver-rotor metal fixture 7 as the occasion may demand. An intermediate gear is used for transmitting an external driving power to the unit 11 and is designed for meshing with a gear, not shown, of an electric motor or other prime mover, also not shown.

Figure 3:
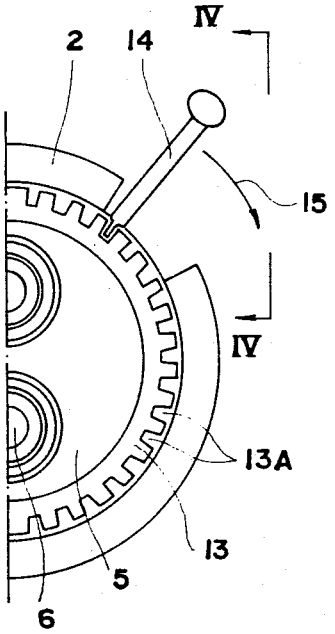
FIG. 3 is a schematic view showing the right-hand side of a bottom plate receiver metal fixture of FIG. 1.
Figure 4:
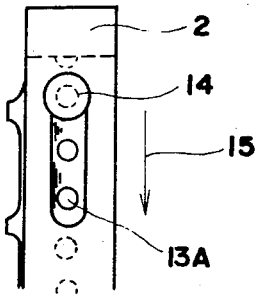
FIG. 4 is a view looking in the direction of the arrows IV—IV of FIG. 3.
Figure 5:
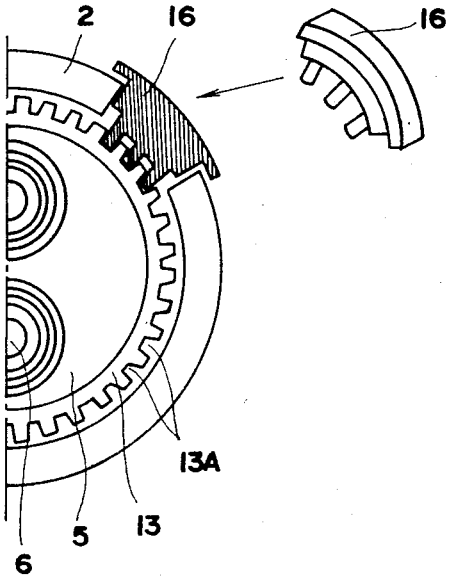
FIG. 5 is a schematic view showing the bottom plate brick receiver metal fixture being locked in rotation.
Figure 6:
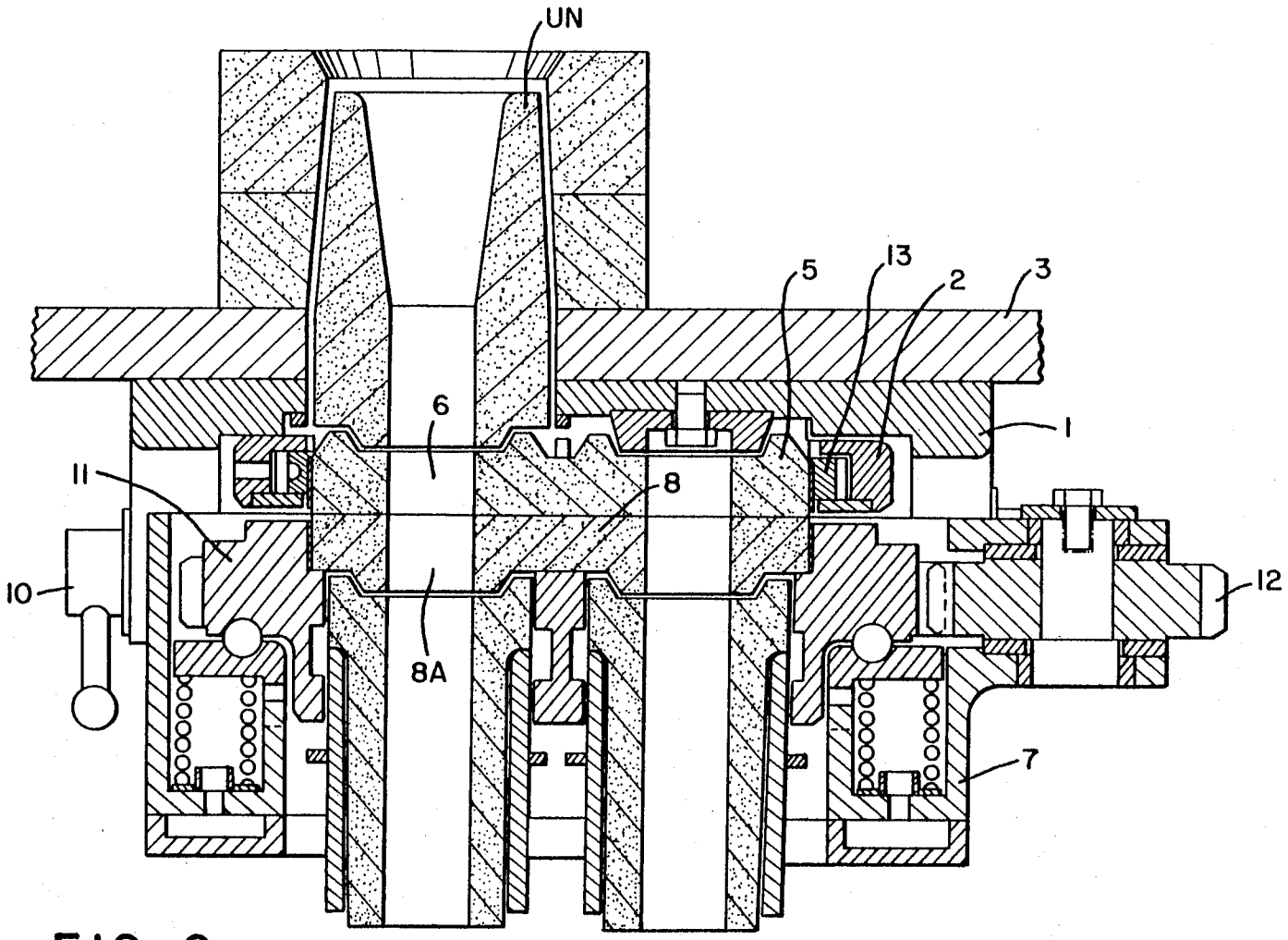
FIG. 6 is a cross-sectional view of a dual door rotary nozzle according to the present invention with both doors in the closed position.
Figure 7:
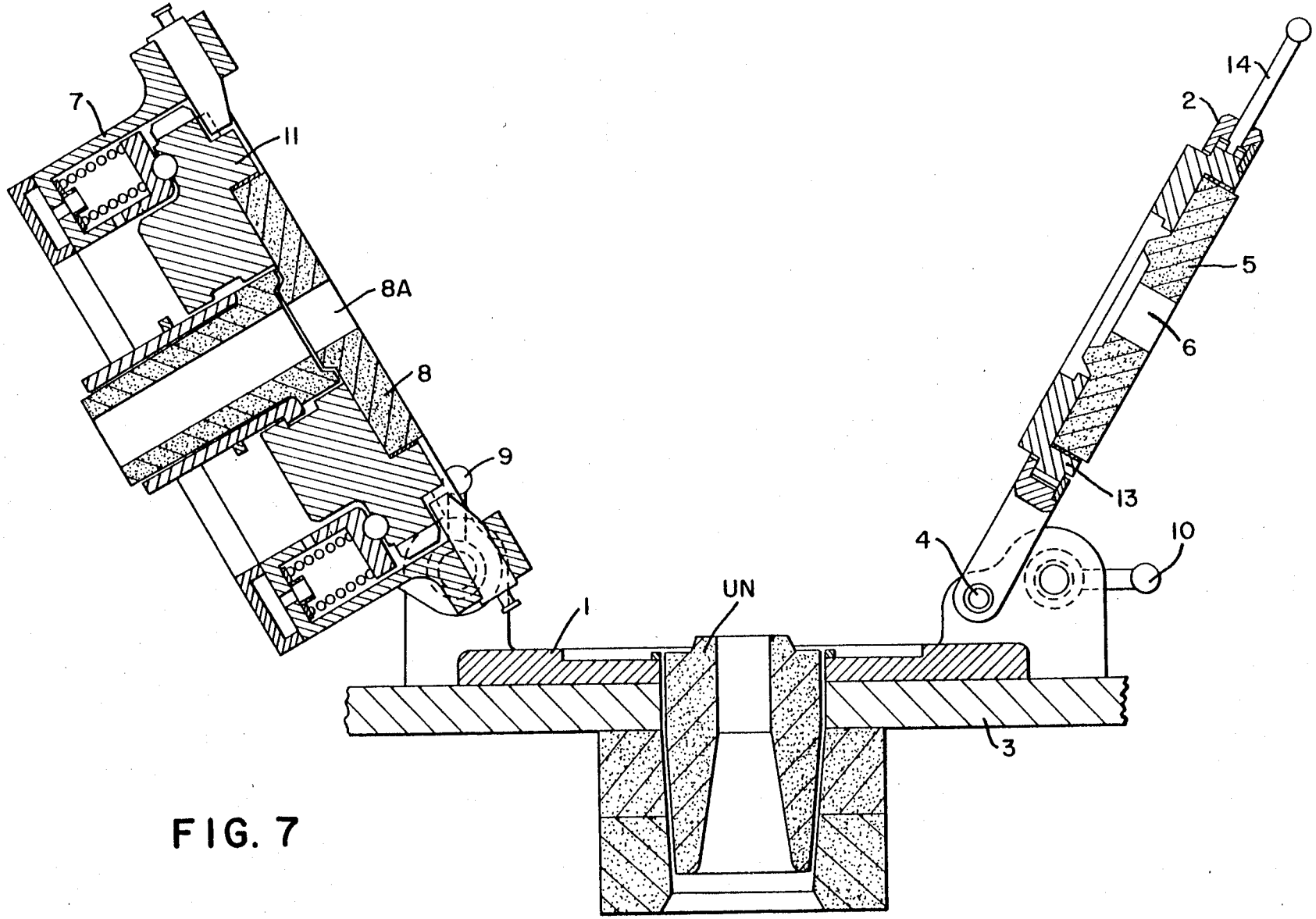
FIG. 7 is a cross-sectional view similar to that of FIG. 6 but with both doors in the open position.

In FIGS. 3 to 5, showing the receiver metal fixture 2 in detail, rotational means 13 is designed to rotate the bottom plate brick 5 and comprises a number of circumferential pin slits 13 A at a substantially constant pitch on the plate brick 5. A separate operating rod 14 may be engaged in said pin slits 13 through a peripheral cut-out in the receiver metal fixture 2 and rotationally operated by an operator in the direction shown by the arrow mark 15 in FIGS. 3 and 4 or in the opposite direction for rotating the bottom plate brick 5 which is housed in the metal fixture 2. After completion of the rotation of the plate brick 5 to the desired angular position, a locking element 16 in the form of a segmental gear shown in FIG. 5 may be engaged into the pin slits 13 A through the peripheral cut-out in the metal fixture 2 for securing the plate brick 5 in such angular position.

In the dual door type rotary nozzle of the present invention, the degree of injury to each plate brick may be advantageously checked by visual inspection similarly to the prior-art door type rotary nozzle. In addition, the rotary plate brick 5 has two nozzle openings fitted respectively with sockets 6 which may be brought into register with the socket of the upper nozzle UN. Thus, in case of injury of one of these nozzle openings, the operating rod 14 may be engaged into one of the pin slits 13 A in the receiver metal fixture 2 as shown in FIGS. 3 and 4 for rotating the rotational means and hence the bottom plate brick 5 in the direction of the arrow mark 15. When the remaining unused nozzle opening is in register with the upper nozzle UN, the locking element 16 is mounted in meshing with the pin slits 13A as shown in FIG. 5 for locking the bottom plate brick 5 in rotation. Then, the bottom plate receiver metal fixture 2 is closed on the base plate 1, and the receiver-rotor metal fixture 7 is then closed on the receiver metal fixture 2. The metal fixtures 2, 7 may then be locked by the operation of the locking pin 10 and the shaft 9. The slide plate brick 8 may now be driven as desired by actuation of the electric motor for driving the rotor unit 11.

In practical execution of the inventive dual door type rotary nozzle, it has been shown that the service life of a set of plate bricks used in a 200-ton ladle can be extended from five charges in the conventional practice up to at least six charges.

What is claimed is:

1. A dual door type rotary nozzle for a ladle used in iron or steel making, said nozzle comprising: a bottom plate brick and a sliding plate brick each having plural nozzle openings, said sliding plate brick being rotatable and disposed under said bottom plate brick, said bottom and sliding plate bricks being swingably mounted for opening and closing in a dual door configuration, said bottom plate brick housed in and rotatably carried by a receiver metal fixture, which in turn is carried by one side of a base plate having a recess for housing the bottom plate brick, said sliding plate brick housed in and rotatably carried by a sliding plate receiver-rotor metal fixture which in turn is carried by the other side of said base plate.

2. The rotary nozzle according to claim 1 wherein the nozzle openings of the bottom plate brick and those of the sliding plate brick are positioned so as to be registrable with one another upon rotation of one or the other plate bricks.

3. The rotary nozzle according to claim 1 wherein the bottom plate brick and the sliding plate brick are superimposed in contact with each other when in the closed position.

4. The rotary nozzle according to claim 1 wherein rotational drive means for said sliding plate brick is mounted inside the sliding plate brick receiver-rotor metal fixture.

5. The rotary nozzle according to claim 1 wherein rotational means for effecting the rotation of the bottom plate brick is provided inside the bottom plate brick receiver metal fixture.

6. The rotary nozzle according to claim 5 wherein said rotational means comprises pin slits arranged at a substantially constant pitch on the circumference of the bottom plate brick.

7. The rotary nozzle according to claim 6 wherein said rotational means is so designed that an operating rod is engaged in the pin slits and operated manually for rotating the bottom plate brick.

8. The rotary nozzle according to claim 6 wherein said rotational means may be locked by a locking element engaged in the pin slits.

* * * * *